US007288052B1

(12) United States Patent
Guillaume

(10) Patent No.: US 7,288,052 B1
(45) Date of Patent: Oct. 30, 2007

(54) EXERCISE DEVICE

(76) Inventor: Vicklyn Guillaume, 1995 Wages Way, Jacksonville, FL (US) 32218

( * ) Notice: Subject to any disclaimer, the term of this patent is extended or adjusted under 35 U.S.C. 154(b) by 251 days.

(21) Appl. No.: 10/888,671

(22) Filed: Jul. 9, 2004

(51) Int. Cl.
*A63B 26/00* (2006.01)

(52) U.S. Cl. ..... 482/142; 482/121; 482/143

(58) Field of Classification Search ..... 482/142, 482/148, 126, 121–130
See application file for complete search history.

(56) References Cited

U.S. PATENT DOCUMENTS

| | | | | |
|---|---|---|---|---|
| 4,351,527 | A | 9/1982 | Crisp | 272/137 |
| 5,071,119 | A | 12/1991 | Johnson | 272/130 |
| 5,480,369 | A * | 1/1996 | Dudley | 482/125 |
| 5,496,245 | A * | 3/1996 | Du Verney | 482/126 |
| 5,551,934 | A * | 9/1996 | Binette | 482/123 |
| 5,749,815 | A * | 5/1998 | Lipps | 482/122 |
| 5,997,448 | A * | 12/1999 | Duba | 482/121 |
| 6,013,013 | A * | 1/2000 | Wolf | 482/111 |
| 6,458,062 | B2 * | 10/2002 | Conner | 482/129 |
| 6,547,705 | B2 | 4/2003 | Yu | 482/112 |
| 6,752,745 | B1 * | 6/2004 | Davis | 482/72 |
| 6,770,011 | B1 * | 8/2004 | Hinds | 482/44 |
| 7,074,131 | B1 * | 7/2006 | Renaud | 473/219 |
| 2004/0147380 | A1 * | 7/2004 | Mattox | 482/139 |
| 2004/0185990 | A1 * | 9/2004 | Orescan et al. | 482/126 |
| 2005/0130814 | A1 * | 6/2005 | Nitta et al. | 482/121 |
| 2006/0052225 | A1 * | 3/2006 | Stearns | 482/140 |
| 2006/0135329 | A1 * | 6/2006 | Owen | 482/123 |

* cited by examiner

*Primary Examiner*—Lori Amerson
(74) *Attorney, Agent, or Firm*—Goldstein Law Offices, P.C.

(57) ABSTRACT

An exercise device for strengthening the abdominal muscles and the arm muscles of a user, comprising a T-shaped, tension loaded press bar that selectively telescopes within an elongated shaft when pressed by the hands of the user. The press bar is mechanically linked to the shaft by a stretchable band having an equilibrium relaxed conformation and also having a stretched conformation. When the user presses down upon the press bar, this causes the press bar to substantially retract into the shaft and simultaneously causes the rubber band to be stretched from its relaxed conformation, thereby simultaneously exercising the muscles of the user. The exercise device may be selectively folded upon three hinges, thereby providing an exercise device that is easily carried, shipped, and stored.

8 Claims, 3 Drawing Sheets

EXERCISE DEVICE

BACKGROUND OF THE INVENTION

1. Field of the Invention

The invention generally relates to an exercise device, and in particular relates to an exercise device for strengthening the abdominal muscles and the arm muscles of a user.

2. Description of the Related Art

Many individuals engage in a variety of exercises designed to strengthen various muscles of the body. Some of these exercises utilize existing exercise devices that target particular areas of the body for strengthening. However, few exercise devices specifically target the arm and abdominal muscles of a user. Moreover, most existing exercise devices are bulky and take up a lot of space, making it difficult for a user to transport the devices between locations, or to store or ship the devices. Accordingly, there is a need for an exercise device which specifically targets the abdominal muscles and the arm muscles of a user, and which may be compactly folded, in order that a user may easily transport and store the device, and also to facilitate shipment of the device.

A variety of exercise devices have been created for strengthening various muscles of the body. For example, U.S. Pat. No. 6,458,062 to Conner to appears to show an exercise device for exercising the spinal and abdominal muscles of a user, having a telescoping stanchion that is tension loaded with resilient bands. Moreover, U.S. Pat. No. 4,351,527 to Crisp, Jr. and U.S. Pat. No. 5,071,119 to Johnson both appear to show an exercise device comprised of a selectively depressible push bar supported upon a vertical column. Additionally, U.S. Pat. No. 6,547,705 to Yu appears to show an exercise device comprised of a pneumatic hand pump which is pivotally attached to a folding chair, for exercising the abdominal muscles of a user.

While these devices may be suitable for the particular purpose employed, or for general use, they would not be as suitable for the purposes of the present invention as disclosed hereafter.

SUMMARY OF THE INVENTION

It is an object of the invention to provide an exercise device for strengthening the abdominal muscles and the arm muscles of a user. Accordingly, the exercise device has a tension loaded press bar which selectively telescopes within an elongated shaft when pressed by the hands of a user. The abdominal muscles and the arm muscles of the user are strengthened as the user presses upon the push bar.

It is another object of the invention to provide an exercise device that is portable. Accordingly, the exercise device may be selectively folded upon three hinges, thereby providing an exercise device that is portable. This feature also allows the device to be easily shipped and stored.

It is yet another object of the invention to provide an exercise device that is not unduly expensive. Accordingly, the exercise device is constructed from readily available materials and its cost is not prohibitive.

Further objects of the invention will become apparent in the detailed description of the invention that follows.

The invention is an exercise device for strengthening the abdominal muscles and the arm muscles of a user. The exercise device comprises a T-shaped, tension loaded press bar that selectively telescopes within an elongated shaft when pressed by the hands of the user. The press bar is mechanically linked to the shaft by a stretchable band having an equilibrium relaxed conformation and also having a stretched conformation. When the user presses down upon the press bar, this causes the press bar to substantially retract into the shaft and simultaneously causes the rubber band to be stretched from its relaxed conformation, thereby simultaneously exercising the muscles of the user. The exercise device may be selectively folded upon three hinges, thereby providing an exercise device that is easily carried, shipped, and stored.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
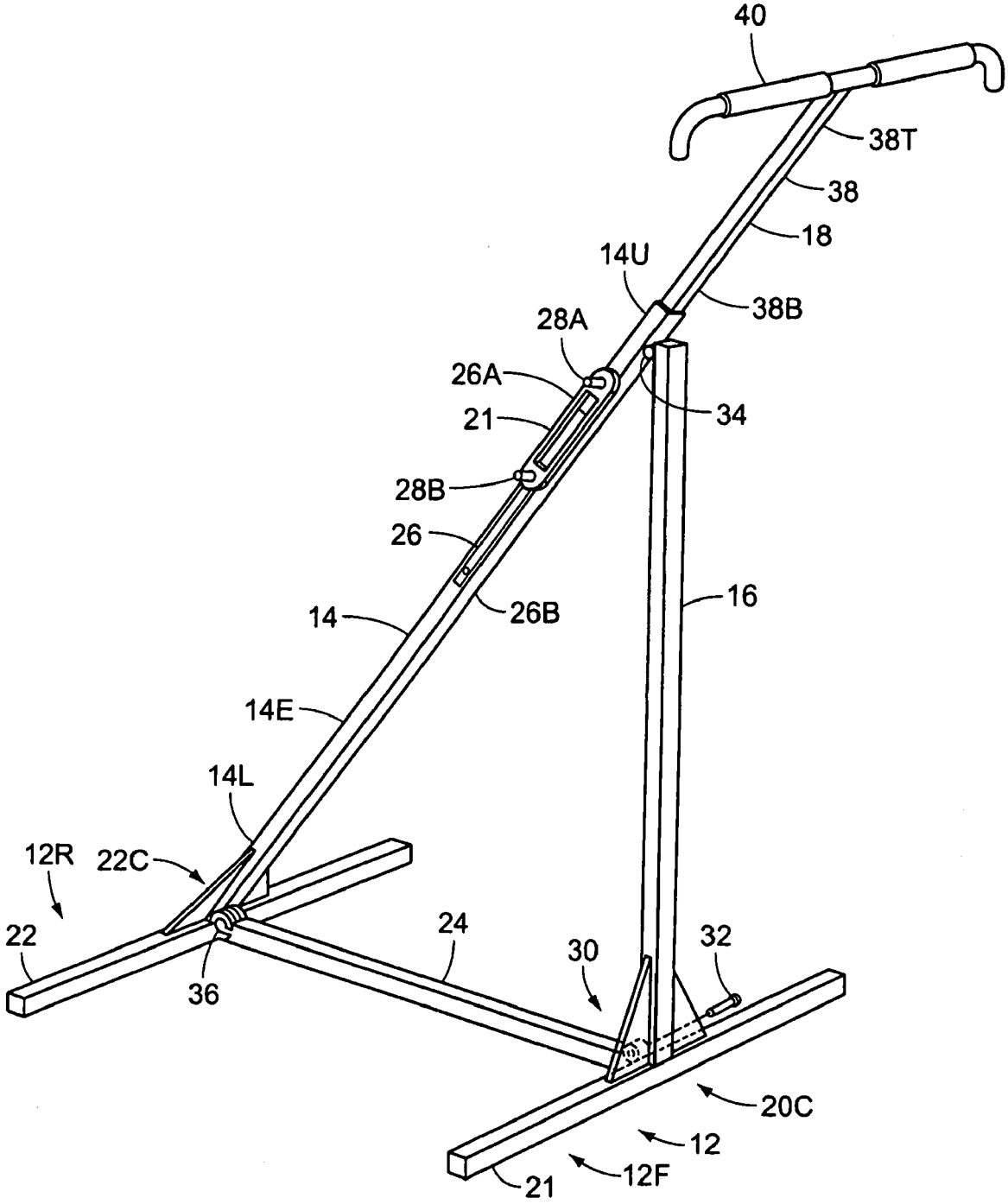
FIG. 1 is a perspective view of an exercise device in a deployed position.

FIG. 1 illustrates an exercise device 10 for strengthening the abdominal muscles and the arm muscles of a user. The exercise device 10 generally comprises a base 12 having a shaft 14 extending diagonally upward therefrom, and having an upright support bar 16 extending vertically upward therefrom. The substantially hollow shaft 14 has an internal bore. The exercise device 10 further comprises a T-shaped press bar 18 which selectively telescopes into the internal bore of the shaft 14. The press bar 18 is mechanically linked to the shaft 14 by a stretchable band 21 having an equilibrium un-stretched conformation and also having a stretched conformation. When the user presses down upon the press bar 18, this causes the press bar 18 to substantially retract into the shaft 14 and simultaneously causes the stretchable band 21 to be stretched, thereby simultaneously exercising the muscles of the user. When the user ceases pressing down upon the press bar 18, the stretchable band 21 returns to its relaxed conformation, and the press bar 18 once again substantially extends from the shaft 14.

The I-shaped base 12 has a front portion 12F having a front prong 20 having a center 20C, a rear portion 12R having a rear prong 22 having a center 22C, and a central bar 22 extending between the center 20C of the front prong 20 and the center 22C of the rear prong 22. The base 12 is used for supporting the exercise device 10 upon a horizontal support structure such as a floor.

The elongated, diagonally situated shaft 14 has an upper portion 14U, a lower portion 14L, and a longitudinal slot 26 having a first end 26A closer to the upper portion 14U of the shaft 14, and having a second end 26B closer to the lower portion 14L of the shaft 14. The shaft 14 has an external surface 14E having a substantially cylindrical band engagement rod 28A extending therefrom, at a location just above the first end 26A of the slot 26. A hinge 36 attaches the lower portion 14L of the shaft 14 to the base 12 in proximity to the center 22C of the rear prong 22 of the base.

Figure 3:
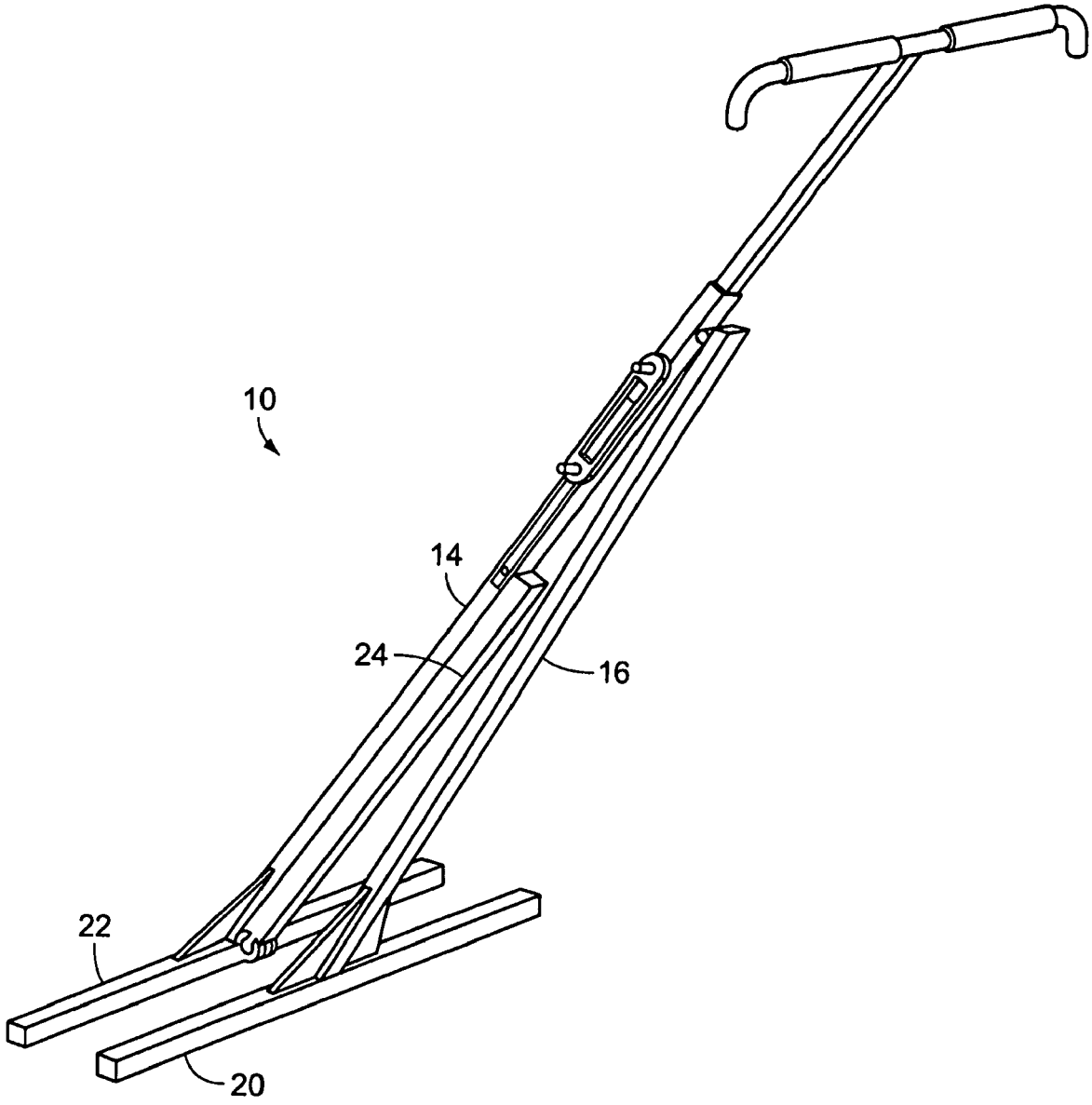
FIG. 3 is a perspective view of an exercise device in a storage position.

The upright support bar 16 extends between the upper portion 14U of the shaft 14 and the center 20C of the front prong 20 of the base 12. The upright support-bar 16 is attached by a hinge 34 to the upper portion 14U of the shaft 14. The upright support bar 16 is attached in proximity to the center 20C of the front prong 20 of the base 12 by a hinge 30 having a selectively removable hinge pin 32. Upon selective removal of the hinge pin 32 from the hinge 30 by the user, the upright support bar 16 is disconnected from the base 12, thereby allowing the exercise device 10 to be compactly folded for storage, at its hinges, 34 and 36. FIG. 3 illustrates the exercise device 10 in the folded storage position, wherein the exercise device 10 occupies a minimal amount of space.

The T-shaped press bar 18 has an elongated rod 38 having a top 38T and a bottom 38B, and has a two-pronged handlebar 40 extending perpendicularly from the top 38T of the elongated rod 38. The press bar 18 has a substantially cylindrical band engagement rod 28B extending from the elongated rod 38. The band engagement rod 28B partially extends from the slot 26. The press bar 18 has an equilibrium extended position wherein the elongated rod 38 is substantially extended from the shaft 14, and a retracted position wherein the elongated rod 38 has been substantially retracted into the shaft 14 by the user pressing down upon the press bar 18.

Figure 2:
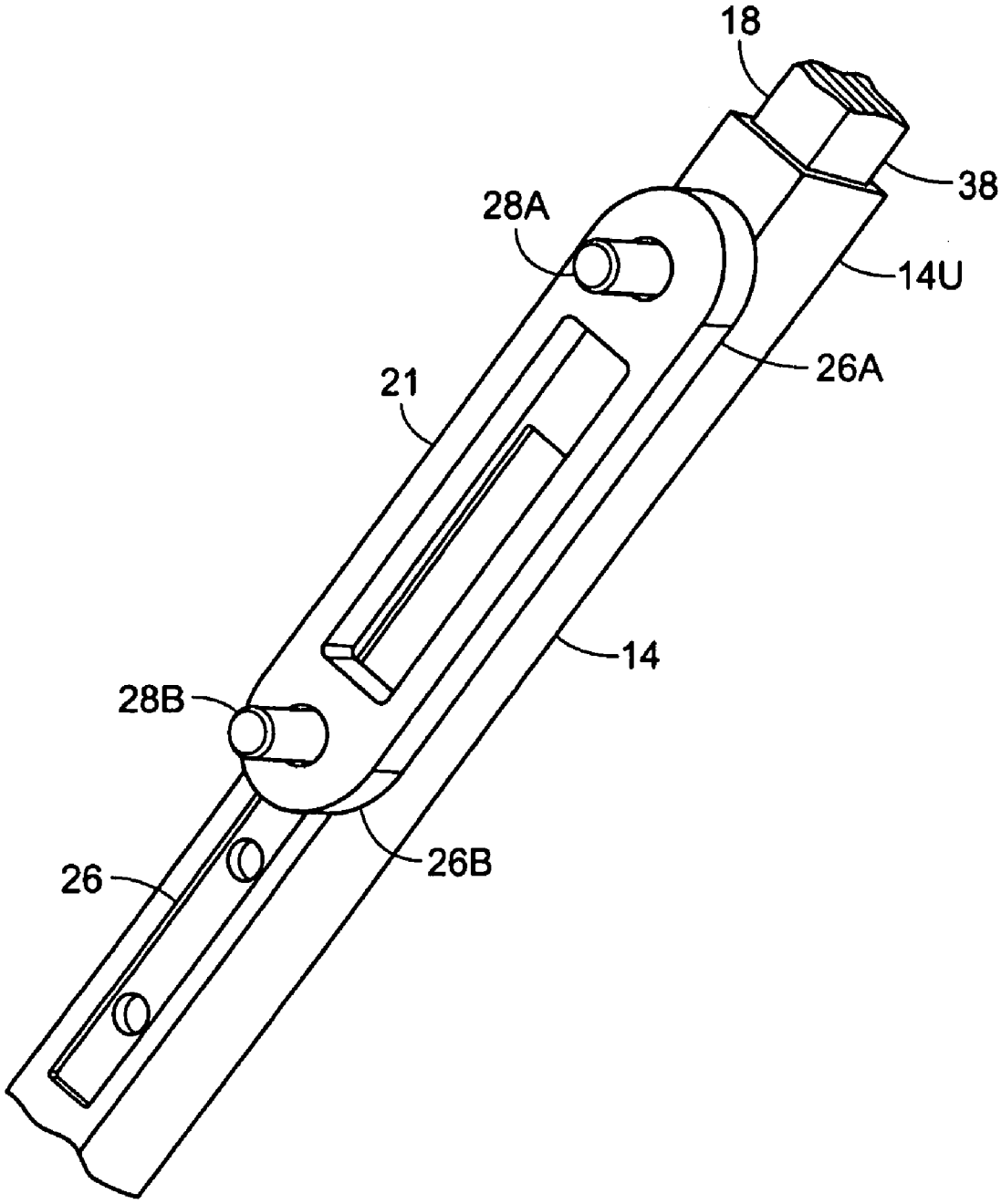
FIG. 2 is an enlarged perspective view of a shaft, and a press bar extending concentrically therein.

FIG. 2 is an enlarged view of the upper portion 14U of the shaft 14, and the press bar 18 extending concentrically therein. The looped stretchable band 21 selectively and simultaneously engages the band engagement rod 28A of the shaft 14, and the band engagement rod 28B of the press bar 18. The rubber band 21 has an equilibrium non-stretched conformation and a stretched conformation. When the user presses down upon the handlebar 40 with the hands of the user, this causes the elongated rod 38 of the press bar 18 to selectively retract into the internal bore of the shaft 14, and simultaneously causes the stretchable band 21 to stretch, thereby exercising the muscles of the user. When the user ceases to press down upon the handlebar 40 with the hands of the user, the stretchable band 21 returns to its equilibrium non-stretched conformation, thereby simultaneously returning the elongated rod 38 of the press bar 18 to its equilibrium extended position. The exercise device 10 may be utilized by a user while in a standing position or in a sitting position.

Although as described, the exercise device 10 utilizes only a single stretchable band 21, it is contemplated that the exercise device 10 may be provided with more than one stretchable band 21, in order to make it more difficult for the user to retract the elongated rod 38 of the press bar 18 into the internal bore of the shaft 14, thereby further strengthening the muscles of the user. The user may attach more than one stretchable band 21 to the device 10 when a more difficult exercise regimen becomes appropriate.

The exercise device 10 is preferably constructed from a strong, light, and durable metal. The stretchable band 21 is preferably constructed from a durable rubber. However, a variety of stretchable materials, including elastic, may be used instead of rubber.

In use, a user presses down upon the handlebar 40 with the hands of the user, thereby causing the elongated rod 38 of the press bar 18 to substantially retract into the internal bore of the shaft 14, and simultaneously causing the stretchable band 21 to stretch, thereby exercising the muscles of the user. When the user ceases to press down upon the handlebar 40 with the hands of the user, the stretchable band 21 returns to its equilibrium non-stretched conformation, thereby simultaneously returning the elongated rod 38 of the press bar 18 to its equilibrium extended position. The user repeats the steps of pressing down upon and ceasing to press down upon the handlebar 40 until the exercise session is over. In order to store the exercise device 10, the user removes the hinge pin 32 from the hinged junction 30, and thereby disconnects the upright support bar 16 from the base 12. The user folds the upright support bar 16 and the central bar 24 of the base 12 substantially flush against the shaft 14, upon the hinges, 34 and 36, respectively, thereby allowing the exercise device 10 to be stored in a minimal amount of space.

In conclusion, herein is presented an exercise device for strengthening the abdominal muscles and the arm muscles of a user. The invention is illustrated by example in the drawing figures, and throughout the written description. It should be understood that numerous variations are possible, while adhering to the inventive concept. Such variations are contemplated as being a part of the present invention.

What is claimed is:

1. An exercise device for strengthening the abdominal muscles and the arm muscles of a user, comprising:

a base for selectively supporting the exercise device, said base having a front portion and a rear portion;

a substantially hollow shaft having an upper portion and having a lower portion attached to and extending diagonally upward from the rear portion of the base, said shaft having an external surface, an internal bore, and a longitudinal slot having a first end closer to the upper portion of the shaft, and having a second end closer to the lower portion of the shaft, said external surface having a band engagement rod extending therefrom, at a location above the first end of the slot;

an upright support bar extending vertically upward from the front portion of the base to the upper portion of the shaft;

a T-shaped press bar having an elongated rod having a top and a bottom, and having a handlebar extending perpendicularly from the top of the elongated rod, wherein the elongated rod selectively telescopes within the internal bore of the shaft, said press bar having an equilibrium extended position wherein the elongated rod is substantially extended from the shaft, and a retracted position wherein the elongated rod is substantially retracted into the shaft by the user pressing down upon the press bar, said press bar having a band engagement rod extending from the elongated rod partially through the slot; and at least one looped stretchable band which simultaneously engages the band engagement rod of the shaft and the band engagement rod of the press bar, said stretchable band having an equilibrium non-stretched conformation and a stretched conformation;

wherein when the user presses down upon the handlebar with the hands of the user, this causes the elongated rod of the press bar to selectively retract into the internal bore of the shaft, and simultaneously causes the stretchable band to stretch, thereby exercising the muscles of the user, and wherein when the user ceases to press down upon the handlebar, the stretchable band returns to its equilibrium non-stretched conformation, thereby simultaneously returning the elongated rod of the press bar to its equilibrium extended position; and wherein the lower portion of the shaft is attached by a hinge to the rear portion of the base, wherein the upright support bar is attached by a hinge to the upper portion of the shaft, and wherein the upright support bar is attached to the front portion of the base by a hinge having a selectively removable hinge pin, wherein upon selective removal of the hinge pin from the hinge by the user, the upright support bar is disconnected from the base, thereby allowing the exercise device to be compactly folded at its hinges, in order to occupy a minimal amount of storage space.

2. The exercise device as recited in claim 1 further comprising:

At least one stretchable band thereby increasing the difficulty to retract the elongated rod of the press bar into the internal bore of the shaft while the user are exercising to strengthen abdominal and arm muscles.

3. The exercise device as recited in claim 2, wherein the base is I-shaped, wherein the front portion of the base has a front prong having a center, wherein the rear portion of the base has a rear prong having a center, and wherein the base has a central bar extending between the center of the front prong and the center of the rear prong.

4. The exercise device as recited in claim 3, wherein the upright support bar extends vertically upward from the center of the front prong of the base.

5. The exercise device as recited in claim 4, wherein the lower portion of the shaft is attached to the center of the rear prong of the base.

6. The exercise device as recited in claim 5, wherein the exercise device is constructed from a strong, light, light-weight, and durable metal.

7. The exercise device as recited in claim 6, wherein the stretchable band is constructed from rubber.

8. The exercise device as recited in claim 6, wherein the stretchable band is constructed from elastic.

* * * * *